US006705032B2

(12) United States Patent
Hoth

(10) Patent No.: US 6,705,032 B2
(45) Date of Patent: Mar. 16, 2004

(54) HOLDER FOR CONSTRUCTION PLANS

(76) Inventor: Ryan C. Hoth, 531 ½ W. 300 North, Logan, UT (US) 84321

( * ) Notice: Subject to any disclaimer, the term of this patent is extended or adjusted under 35 U.S.C. 154(b) by 0 days.

(21) Appl. No.: 09/775,752

(22) Filed: Jan. 31, 2001

(65) Prior Publication Data

US 2002/0100196 A1 Aug. 1, 2002

(51) Int. Cl.[7] ..... G09F 11/18
(52) U.S. Cl. ..... 40/514; 40/515
(58) Field of Search ..... 40/600, 515, 514, 40/116; 403/315

(56) References Cited

U.S. PATENT DOCUMENTS 601,416 A * 3/1898 Harrison ..... 40/514 X
956,047 A * 4/1910 Davis ..... 403/315
1,027,394 A * 5/1912 Patterson ..... 40/515
1,219,386 A * 3/1917 Fernandez ..... 40/514 X
1,320,918 A * 11/1919 Reyer ..... 40/514 X
4,345,392 A * 8/1982 Cornell ..... 40/514 X
4,525,946 A * 7/1985 Olson ..... 40/514
4,679,822 A * 7/1987 Wolfe ..... 40/514 X
5,711,100 A * 1/1998 Elmer ..... 40/600 X
6,138,394 A * 10/2000 Sulenski ..... 40/600 X

* cited by examiner

*Primary Examiner*—Joanne Silbermann
(74) *Attorney, Agent, or Firm*—Fehr Law Firm; Thompson E. Fehr

(57) ABSTRACT

A holder for construction plans having a cylindrical rod rotatably mounted between a first perpendicular segment attached to the first end of a base and a second perpendicular segment attached to the second end of the base. A first end of the cylindrical rod passes through the first perpendicular segment and can be used to rotate the cylindrical rod. One end of the construction plans can be folded and inserted into a longitudinal groove that exists in the cylindrical rod. Optionally, a peg removably fits into an opening transversely located in the rod to prevent the rod from slipping from its intended position; and magnets may be attached to the bottom of the base to hold it releasably on a motor vehicle.

6 Claims, 2 Drawing Sheets

HOLDER FOR CONSTRUCTION PLANS

BACKGROUND OF THE INVENTION

1. Field of the Invention

This invention relates to a device for storing and displaying construction plans.

2. Description of the Related Art

A number of patents have been issued for rollers which store and display elongated, flexible material, such as maps.

These include U.S. Pat. Nos. 1,812,171; 1,823,996; 2,589,641; 4,157,626; 4,525,946; 4,794,715; 5,392,549; 5,966,854; and 6,038,800.

Except for U.S. Pat. Nos. 2,589,641; 4,157,626; and 5,996,854, the devices covered by the preceding patent are complex and subject to be damaged by the dirt that exists around construction sites.

The device of U.S. Pat. No. 2,589,641 has no means for attaching the wallpaper that it holds to the cylindrical rod and also appears merely to rotate the roll of wallpaper, having no described means for rotating the rod.

The technology of U.S. Pat. No. 4,157,626 does not employ a roller or cylinder.

And the Roll-up Information Display of U.S. Pat. No. 5,966,854 only utilizes a "self-coiling display sheet."

The Motor-driven Map Holder of U.S. Pat. No. 4,794,715 has a longitudinal groove in a cylindrical rod for attaching one end of the elongated, flexible material to the rod; but, as noted above, the Motor-driven Map Holder of that patent is complex and subject to having its operation degraded by the dirt around a construction site.

Finally, the similarly complex Map Display and Storage Device of U.S. Pat. No. 5,392,549 employs separate knobs attached to the cylindrical rods.

SUMMARY OF THE INVENTION

The present Holder for Construction Plans is simple in structure so that its operation will not be adversely affected by the dirt at a construction site.

A longitudinal groove in a cylindrical rod retains a folded end of the construction plans, and the rod is rotated simply with a first end of the cylindrical rod.

Moreover, the Holder is adapted for being removably but securely attached to a motor vehicle.

DESCRIPTION OF THE PREFERRED EMBODIMENT

Figure 1:
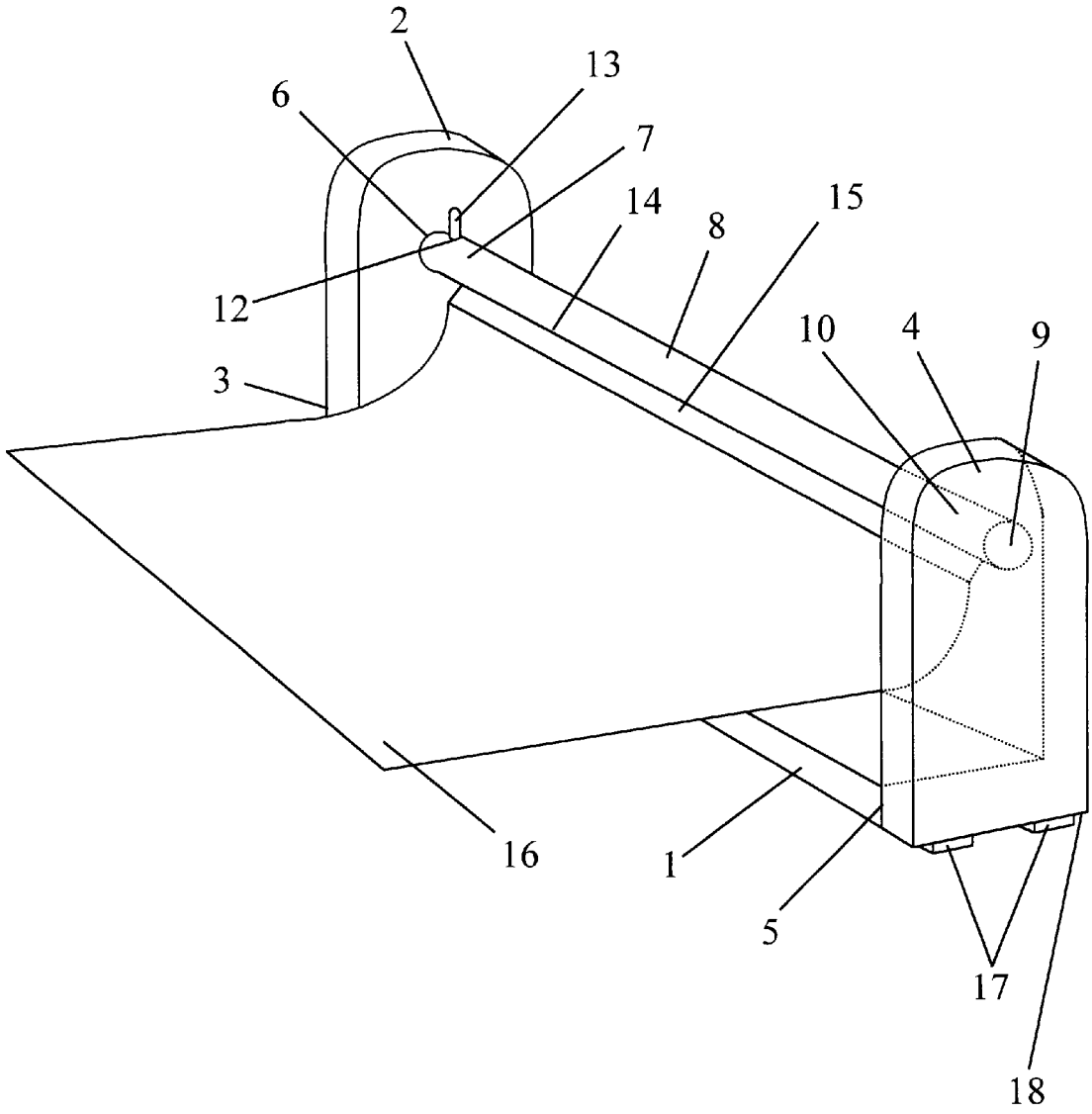
FIG. 1 is an isometric view of the Holder for Construction Plans.
Figure 2:
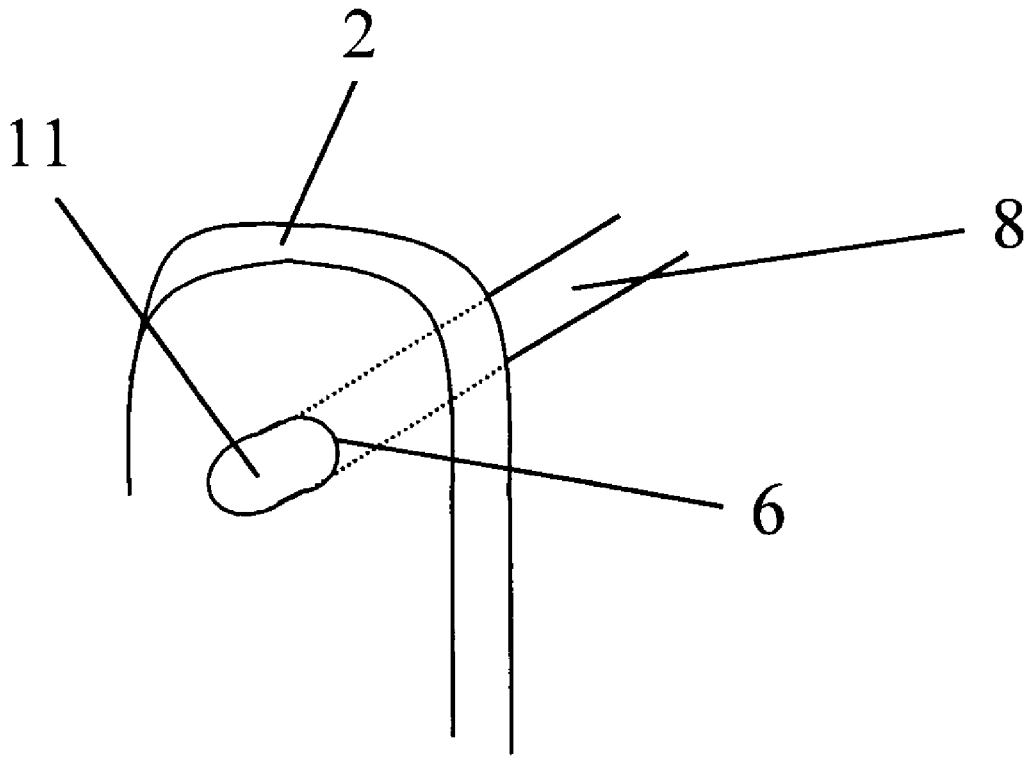
FIG. 2 illustrates knob used for turning the cylindrical rod.

Construction plans are often bulky and difficult to store.

The present Holder for Construction Plans enables such plans to be rolled for storage and unrolled for review.

The Holder comprises a base 1 with a first perpendicular segment 2 attached to a first end 3 of the base 1 and a second perpendicular segment 4 attached to a second end 5 of the base 1. The first perpendicular segment 2 contains an aperture 6 through which a first end 7 of a cylindrical rod 8 extends.

The second perpendicular segment 4 contains a cavity 9 to releasably retain the second end 10 of the cylindrical rod 8.

The first end 7 of the cylindrical rod 8 is shaped in the form of a knob 11.

An opening 12 is transversely located in the cylindrical rod 8 near the first end 7 of such rod 8 but sufficiently far from such first end 7 that such opening 12 will be situated between the first perpendicular segment 2 and the second perpendicular segment 4 when the second end 7 of the cylindrical rod 8 is retained by the cavity 9 in the second perpendicular segment 4. In order to preclude the cylindrical rod 8 from inadvertently slipping from the second perpendicular segment 4, a peg 13 is removably inserted into the opening 12. The dimensions of the peg 13 are such that friction will removably retain it within the opening 12.

The cylindrical rod 8 contains a longitudinal groove 14. When an end 15 of the construction plans 16 is folded back upon itself, such folded end 15 is inserted into and retained by the groove 14. The construction plans 16 can then be rolled or unrolled by turning the knob 11.

Magnets 17 may, furthermore, be placed on the bottom 18 of the base 1 for removably retaining the Holder on a vehicle.

I claim:

1. A holder for construction plans which comprises:

a base having a first end and a second end;

a first perpendicular segment attached to the first end of said base, said first perpendicular segment having an aperture;

a second perpendicular segment attached to the second end of said base, said second perpendicular segment containing a cavity;

a cylindrical rod having a first end that passes through the aperture in said first perpendicular segment, a second end removably inserted into the cavity of said second perpendicular segment, and a longitudinal groove, wherein the first end of said cylindrical rod is shaped in the form of a knob and said cylindrical rod contains an opening transversely located in said cylindrical rod near the first end of said cylindrical rod but sufficiently far from the first end of said cylindrical rod that the opening will be situated between said first perpendicular segment and said second perpendicular segment when the second end of said cylindrical rod is retained by the cavity in the second perpendicular segment; and a peg for removable insertion into said opening, said peg having such dimensions that friction will removably retain said peg within the opening.

2. The holder for construction plans as recited in claim 1, further comprising:

a means for removably retaining said base on a vehicle.

3. The holder for construction plans as recited in claim 2, wherein:

said means comprises magnets attached to the bottom of said base.

4. A holder for construction plans which comprises:

a base having a first end and a second end;

a first perpendicular segment attached to the first end of said base, said first perpendicular segment having an aperture;

a second perpendicular segment attached to the second end of said base, said second perpendicular segment containing a cavity;

a cylindrical rod having a first end that passes through the aperture in said first perpendicular segment, a second end removably inserted into the cavity of said second perpendicular segment, and a longitudinal groove, wherein said cylindrical rod contains an opening transversely located in said cylindrical rod near the first end of said cylindrical rod but sufficiently far from the first end of said cylindrical rod that the opening will be situated between said first perpendicular segment and said second perpendicular segment when the second end of said cylindrical rod is retained by the cavity in the second perpendicular segment; and a peg for removable insertion into said opening, said peg having such dimensions that friction will removably retain said peg within the opening.

5. The holder for construction plans as recited in claim 4, further comprising:

a means for removably retaining said base on a vehicle.

6. The holder for construction plans as recited in claim 5, wherein:

said means comprises magnets attached to the bottom of said base.

* * * * *